US005588583A

United States Patent [19]

Cargile, Jr.

[11] Patent Number: 5,588,583

[45] Date of Patent: Dec. 31, 1996

[54] PAPERBOARD CONTAINER HAVING FLEXIBLE PRODUCT DIVIDING KEEL

[75] Inventor: John W. Cargile, Jr., Decatur, Ga.

[73] Assignee: Kliklok Corporation, Decatur, Ga.

[21] Appl. No.: 443,231

[22] Filed: May 17, 1995

[51] Int. Cl.[6] ..... B65D 25/04

[52] U.S. Cl. ..... 229/120.17; 229/190; 229/197

[58] Field of Search ..... 229/120.05, 120.08, 229/120.16, 120.17, 190, 195, 197

[56] References Cited

U.S. PATENT DOCUMENTS

| | | | |
|---|---|---|---|
| 1,170,776 | 2/1916 | Nagle . | |
| 2,217,028 | 10/1940 | Powell . | |
| 2,663,491 | 12/1953 | Hill et al. | 229/120.17 |
| 3,181,771 | 5/1965 | Galloway | 229/197 |
| 3,236,433 | 2/1966 | Barrett et al. | 229/120.05 |
| 3,255,947 | 6/1966 | Bixler et al. | 229/120.17 X |
| 3,721,380 | 3/1973 | Meyers | 229/120.17 |
| 4,848,648 | 7/1989 | Eisman . | |
| 4,905,889 | 3/1990 | Schuster | 229/120.17 |
| 4,944,451 | 7/1990 | Forbes, Jr. | 229/120.17 |
| 5,009,363 | 4/1991 | Zavatone | 229/120.17 |
| 5,265,796 | 11/1993 | Gulliver et al. | 229/120.16 |
| 5,356,070 | 10/1994 | Rigby | 229/120.17 |

*Primary Examiner*—Allan N. Shoap
*Assistant Examiner*—Christopher J. McDonald
*Attorney, Agent, or Firm*—Jones & Askew

[57] ABSTRACT

A paperboard multiple compartment tray-type container erectable from a blank, having a product dividing keel which provides structure as well as flexibility to the container. The container may have tapered or vertical sides. The container is formed from a die-cut and scored blank of paperboard or other sheet material, and includes locking devices which allow for mechanical forming of a multiple compartment tray without the need for adhesives.

20 Claims, 9 Drawing Sheets

PAPERBOARD CONTAINER HAVING FLEXIBLE PRODUCT DIVIDING KEEL

TECHNICAL FIELD

The present invention relates in general to containers for holding products delivered therein, and particularly relates to such containers which have a dividing keel which provides structural integrity to a particular container, but may also be flexed without disadvantageously damaging or disassembling the container.

SUMMARY OF THE INVENTION

The present invention overcomes inadequacies in the prior art by providing a paperboard container erectable from a blank which when assembled defines at least two product cavities separated by a dividing keel. The product dividing keel provides advantageous structure to the container but also allows for some flexing of the container, thus reducing the opportunity for paperboard damage.

Therefore, it is an object of the present invention to provide an improved paperboard container.

It is a further object of the present invention to provide an improved paperboard container which is easy to erect.

It is a further object of the present invention to provide an improved paperboard container which is resistant to damage.

It is a further object of the present invention to provide an improved paperboard container which is simple in construction.

It is a further object of the present invention to provide an improved paperboard container which is simple in erection.

It is a further object of the present invention to provide an improved paperboard container which is efficient in the use of paperboard.

It is a further object of the present invention to provide an improved paperboard container which accommodates a high level of mishandling.

It is a further object of the present invention to provide an improved paperboard container which can be nestable when erected.

It is a further object of the present invention to provide an improved paperboard container which may be erected from a single paperboard blank.

Other objects, features, and advantages of the present invention will become apparent upon reading the following detailed description of the preferred embodiment of the invention when taken in conjunction with the drawing and the appended claims.

DETAILED DESCRIPTION OF THE PREFERRED EMBODIMENT

Referring is now made to the figures, where like numerals designate like objects throughout the several views.

First Embodiment

Figure 1:
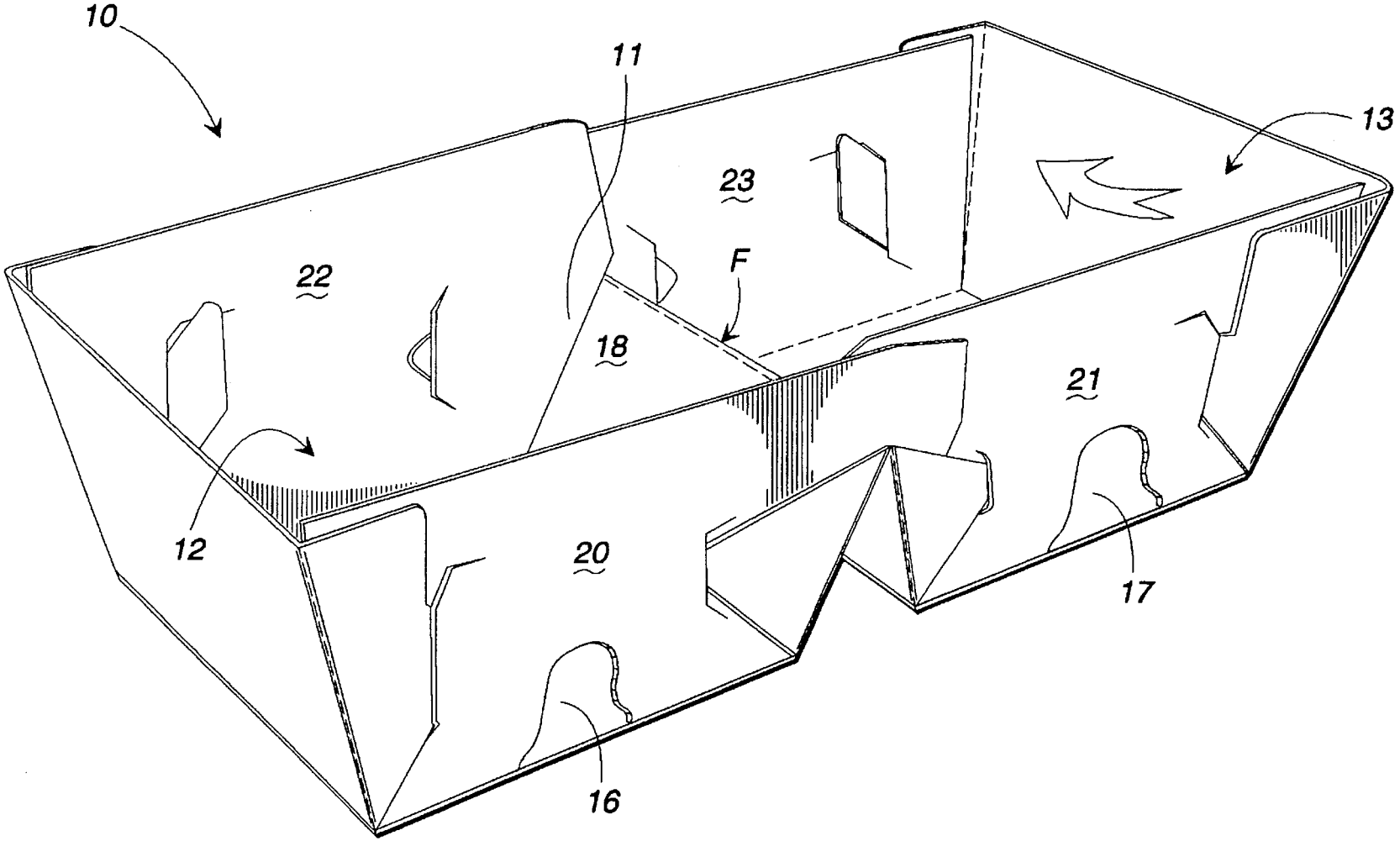
FIG. 1 is a pictorial view of a first embodiment of a paperboard container 10 according to the present invention. For purposes of this discussion, the front or forward face of the container is the face which most directly faces the viewer, and which is also the longer of the two outside faces seen by the viewer.
Figure 2A:
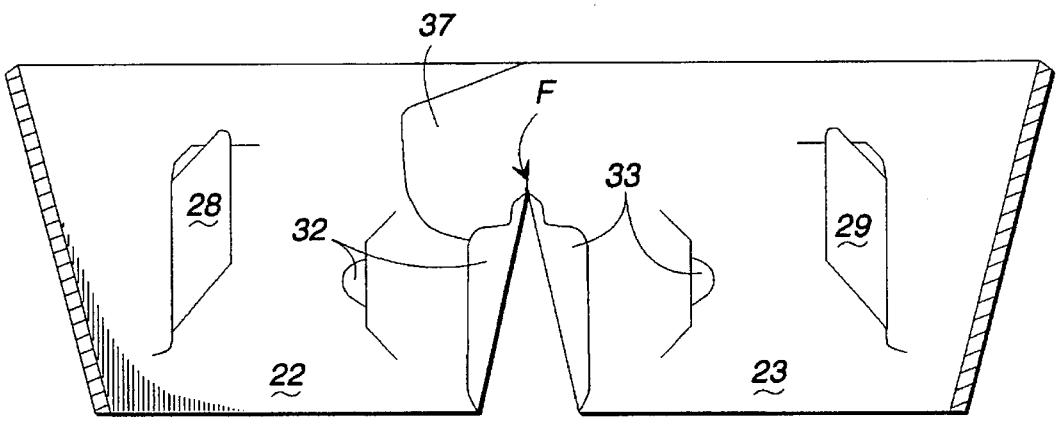
FIGS. 2A and 2B are front elevational views of the container of FIG. 1, with FIG. 2A being a cutaway view with the cross-section taken "behind" the front side panels 20, 21 of the container. The container is fully viewable in FIG. 2B.
Figure 2B:
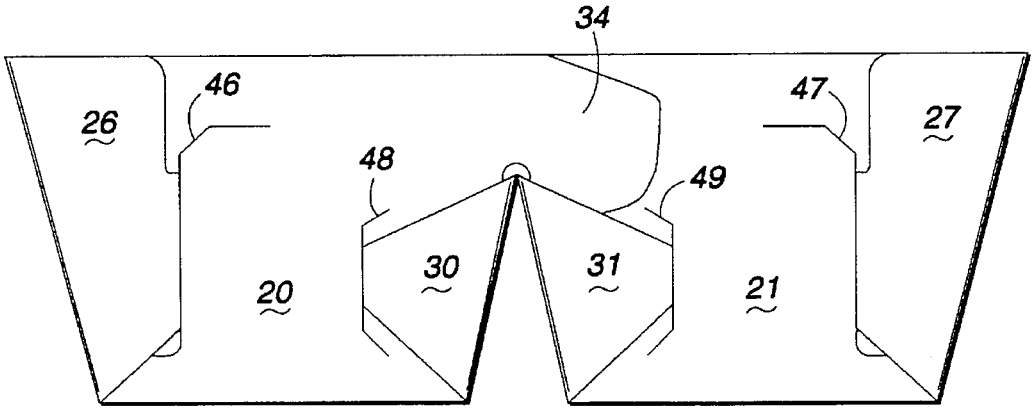

Referring now to FIGS. 1 and 2, a first preferred embodiment of a container 10 is shown which includes a single tapered keel 11 separating first and second upwardly-opening product holding compartments 12, 13, which include tapered side walls. As discussed in further detail, the keel 11 provides yieldable structure to the container as it holds product (not shown) in its compartments 12, 13.

Figure 3:
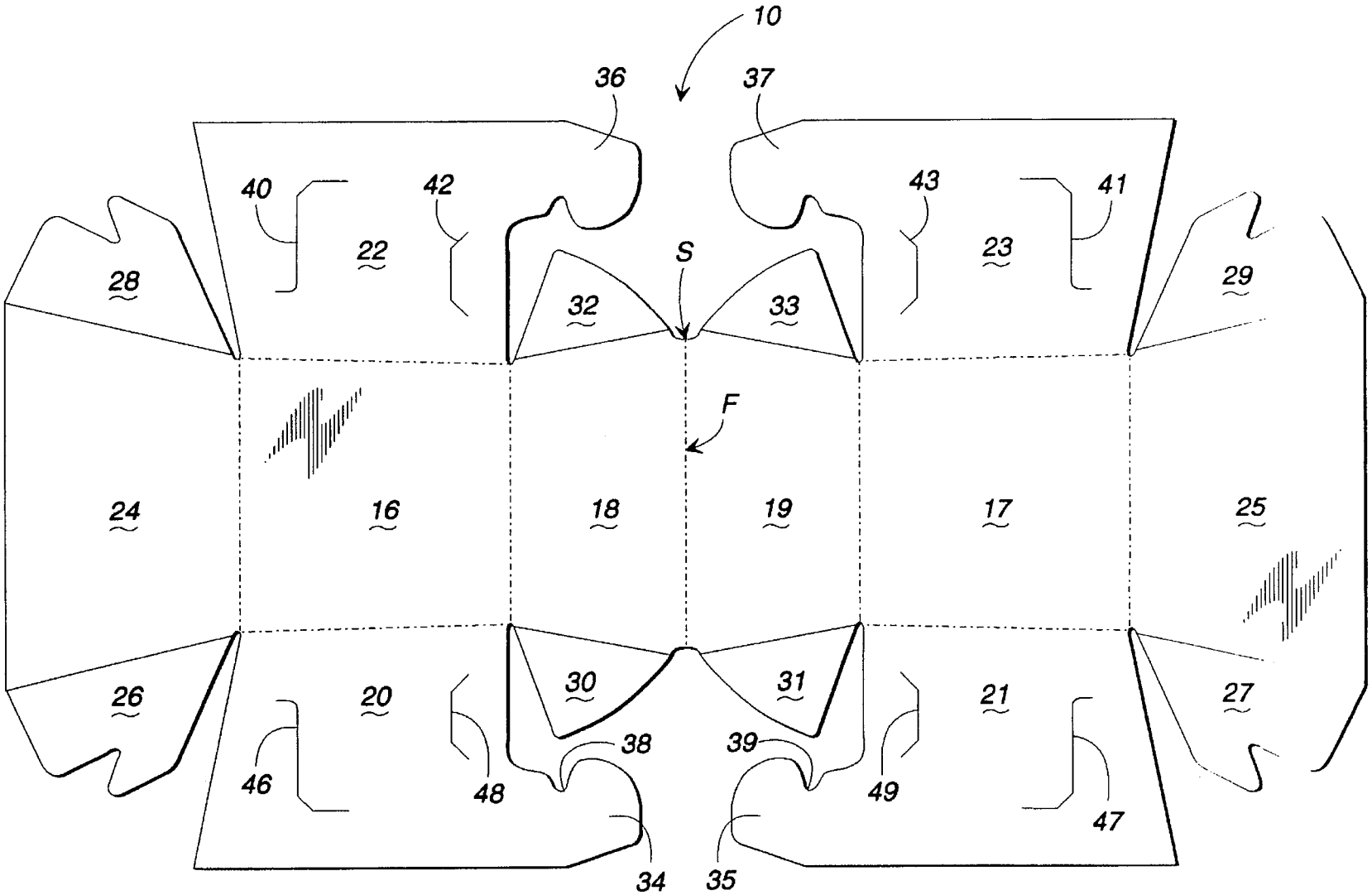
FIG. 3 is a top plan view of an first embodiment of the invention, a paperboard blank for forming a two-compartment container having a tapered keel and tapered side walls.

Reference is now made to FIG. 3, which is a top plan of a paperboard blank for forming a two-compartment container 10 such as shown in FIG. 1. The blank 10 includes first and second floor panels 16, 17, upon which a food product or other products may be placed. A pair of keel panels 18, 19, are foldably connected to each other along central fold line F, and combine to comprise a downwardly and outwardly tapered keel 11. The floor panels 16, 17, are foldably attached to corresponding keel panels 18, 19, along fold lines. Keel flaps 31, 33, are foldably attached to keel panel 19, and keel flaps 30, 32, are foldably attached to keel panel 18. Front and rear side panels 21, 23, are foldably attached to floor panel 17, and front and rear side panels 20, 22 are foldably attached to floor panel 16. Panels 20, 21, 22, and 23 are similar in shape, and using panel 20 as an example, each includes an open-ended notch such as 38, a hook 34, and locking slits such as 46, 48. Right and left side panels 25, 24, respectively, are similar in outline. Corner lock flaps 26, 28, are foldably attached to left side flap 24, and corner lock flaps 27, 29, are foldably attached to right side flap 25.

Figure 4:
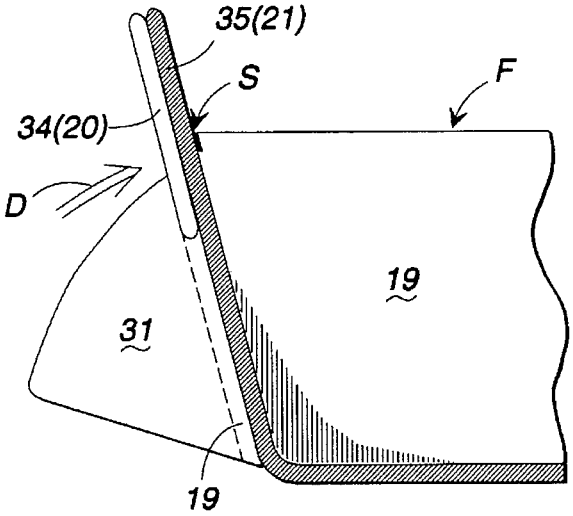
FIG. 4 is a right side partial cutaway partial view of the container shown in FIG. 1, illustrating by arrow "D" the folding of the front side panels 20, 21 prior to their securement by the keel flaps 31 and 30 (not shown).

Erection of the blank of FIG. 3 into the container of FIG. 1 is now discussed. The floor or base panels 16, 17 are brought together by folding the keel panels 18, 19 along fold line F into an inverted "V" until notches 38, 39 in the front side panels 20, 21 align one over the other. The floor panels 16, 17 are now at their final erected positions. Erection of the front of the container is now discussed. Referring particularly to FIG. 4, the front side panels 20, 21 are then folded upwardly together, clearing the keel flaps 30, 31 until the notches 38, 39 fit over and engage the keel 11, and stop at the flat stop S, which in the embodiment shown is defined by the keel and is also in the form of an inverted "V", albeit a smaller one than that formed by the keel. As shown in FIG. 4, it may be understood that the inwardmost front side panel 21 is in contact with the stop S, with the outermost front panel 20 right behind it. The keel flaps 30, 31, are then folded upwardly that the outer tips of the flaps 30, 31, overlap corresponding cuts 48, 49 in panels 20, 21, respectively. The tips of the keel flaps 30, 31 are then mechanically punched inwards to engage the cuts 48, 49 as shown in FIG. 2. Meanwhile, the tips of corner lock flaps 26, 27 are threaded into cuts 46, 47(as the front side panels 20, 21 are folded up) and the tips are pulled inward to engage the lock at the corners. Folding of the rear side flaps 22, 23, and associated elements is simultaneously done in a "mirror image" fashion.

As may be seen, the keel divider between the cavities (also known as "cells") is of partial depth. It may be understood that in reference to FIG. 3, all of the folds made along the fold lines are made in one direction with the exception of the central fold line F.

By using the keel divider and engagement concept discussed above, many different variations of packaging may be obtained. For example two, three or more compartments may be provided. The container may also have tapered or vertical sides. The keel may be vertical or tapered.

Second Embodiment

Figure 5:
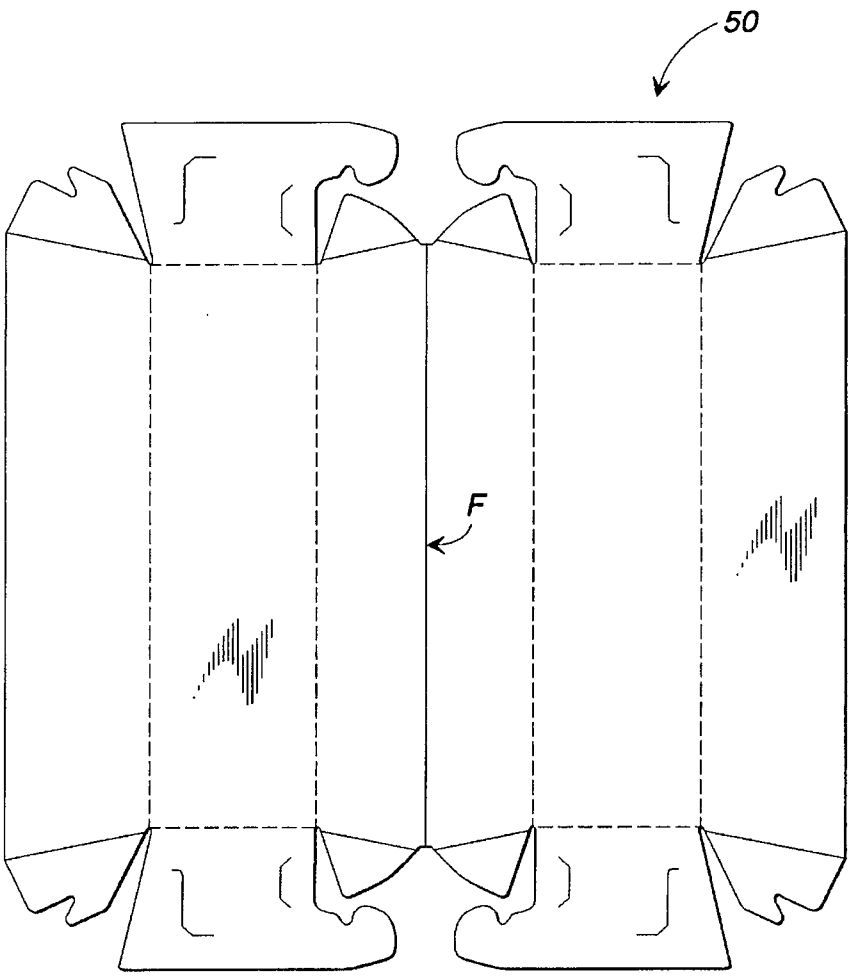
FIG. 5 is a top plan view of an second embodiment of the invention, a paperboard blank for forming a two-compartment container having a tapered keel and tapered side walls.

Reference is now made to FIG. 5, which is a top plan view of an second, "longer", embodiment of the invention, a paperboard blank 50 for forming a two-compartment container having a central fold line F, a tapered keel and tapered side walls. As may be understood, construction and operation of this container is similar to that described in connection with the first embodiment of the invention.

Third Embodiment

Figure 6:
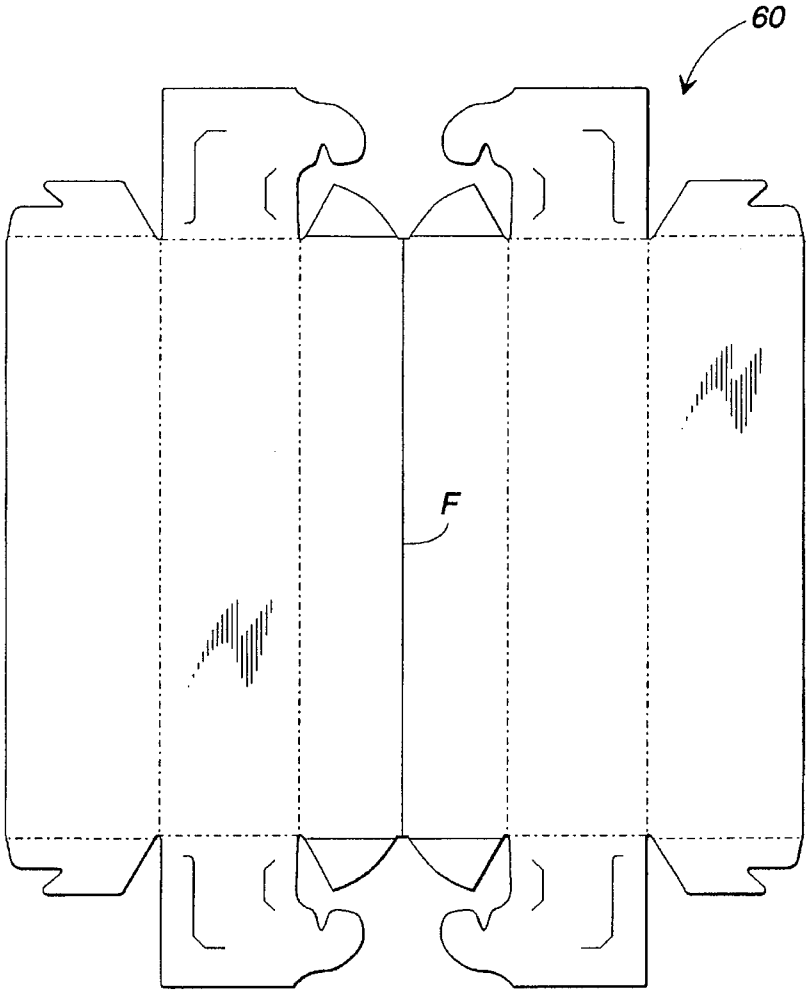
FIG. 6 is a top plan view of an third embodiment of the invention, a paperboard blank for forming a two-compartment container having a tapered keel and vertical side walls.

Reference is now made to FIG. 6, which is a top plan view of an third embodiment of the invention, a paperboard blank 60 for forming a two-compartment container having a central fold line F, a tapered keel and vertical side walls. As may be understood, construction and operation of this container is similar to that described in connection with the first embodiment of the invention.

Fourth Embodiment

Figure 7:
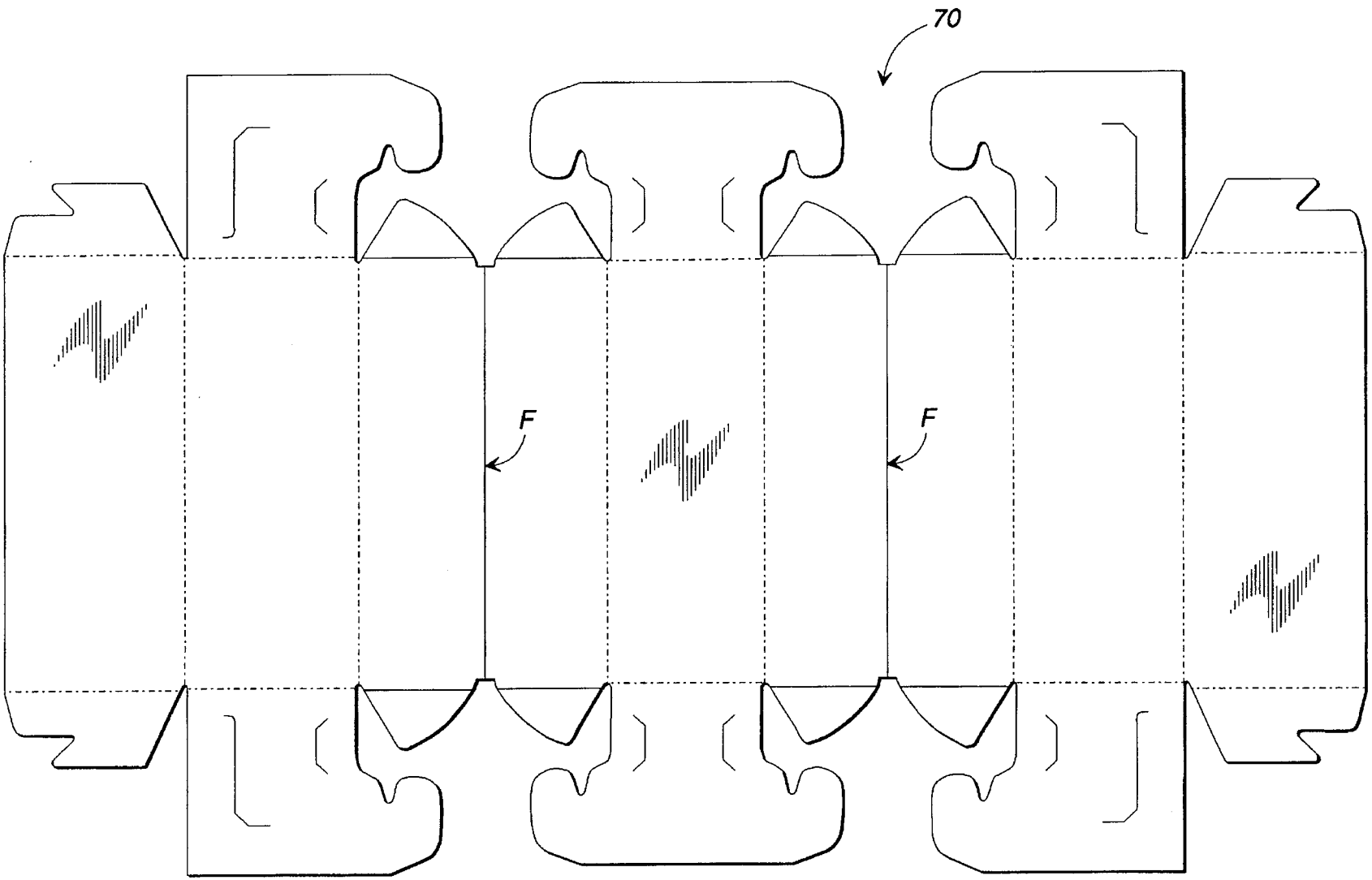
FIG. 7 is a top plan view of an fourth embodiment of the invention, a paperboard blank for forming a three-compartment container having a tapered keel and vertical side walls.

Reference is now made to FIG. 7, which is a top plan view of an fourth embodiment of the invention, a paperboard blank 70 for forming a three-compartment container having a pair of fold lines F, a pair of tapered keels, and vertical side walls. As may be understood, construction and operation of this container is similar to that described in connection with the first embodiment of the invention.

Fifth Embodiment

Figure 8:
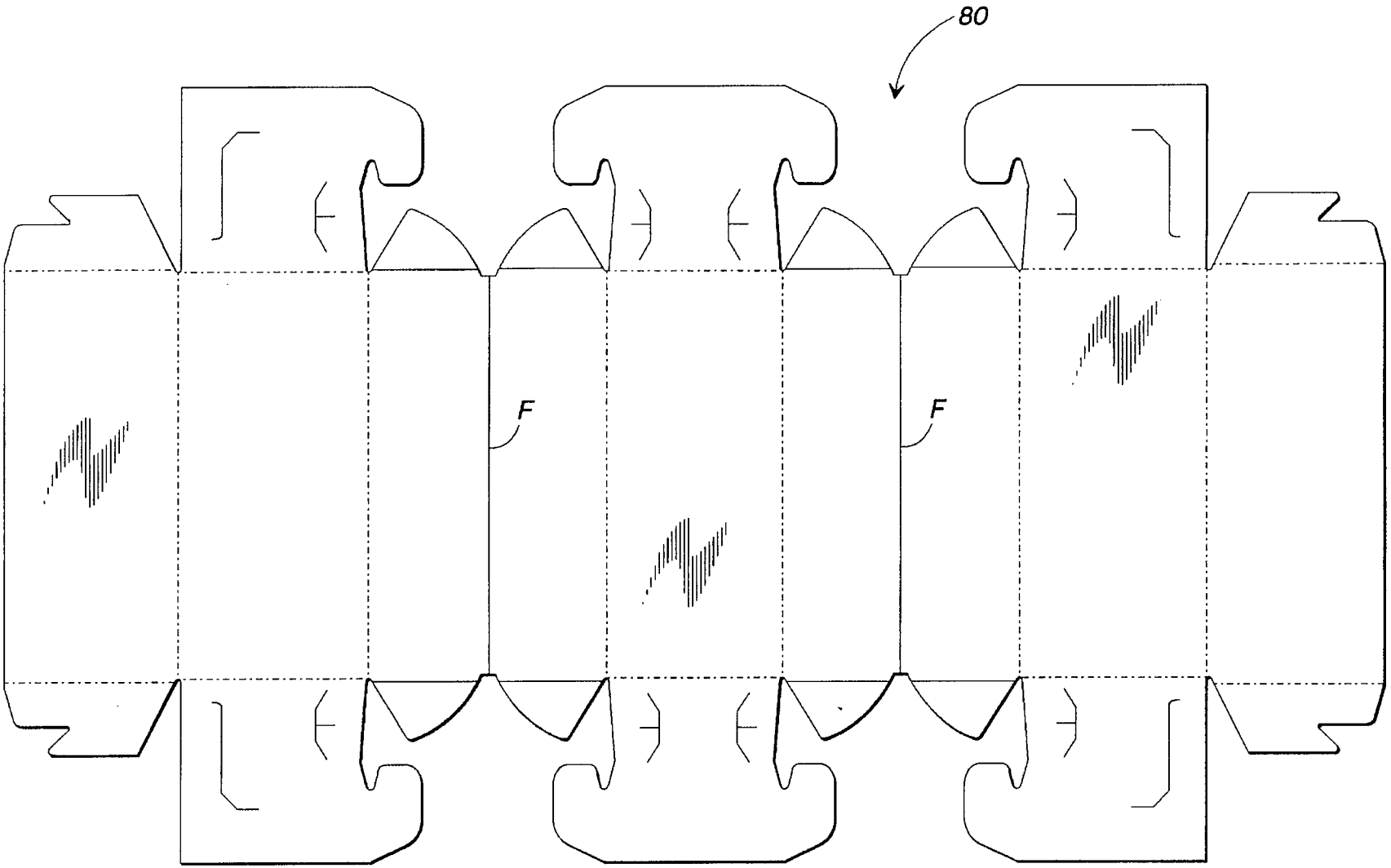
FIG. 8 is a top plan view of an fifth embodiment of the invention, a paperboard blank for forming a three-compartment container having a vertical keel and vertical side walls.

Reference is now made to FIG. 8, which is a top plan view of an fifth embodiment of the invention, a paperboard blank 8 for forming a three-compartment container having a pair of fold lines F, a pair of vertical keels and vertical side walls. As may be understood, construction and operation of this container is similar to that described in connection with the first embodiment of the invention.

Sixth Embodiment

Figure 9:
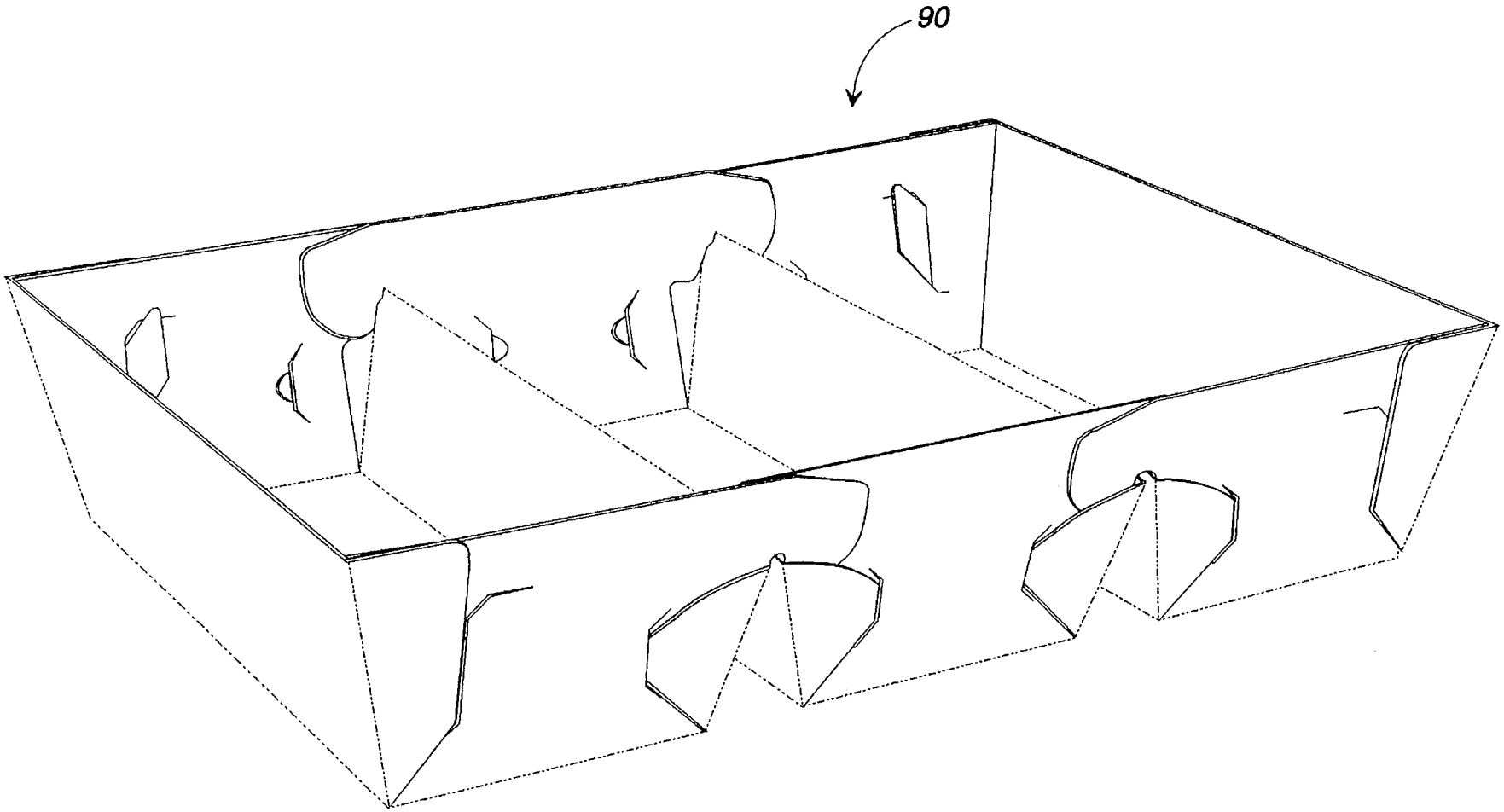
FIG. 9 is a pictorial view of an sixth embodiment of the invention, a formed three-compartment container having tapered keels and tapered side walls.

Reference is now made to FIG. 9, which is a pictorial view of an sixth embodiment of the invention, a formed three-compartment container 90 having two tapered keels and tapered side walls.

Seventh Embodiment

Figure 12:
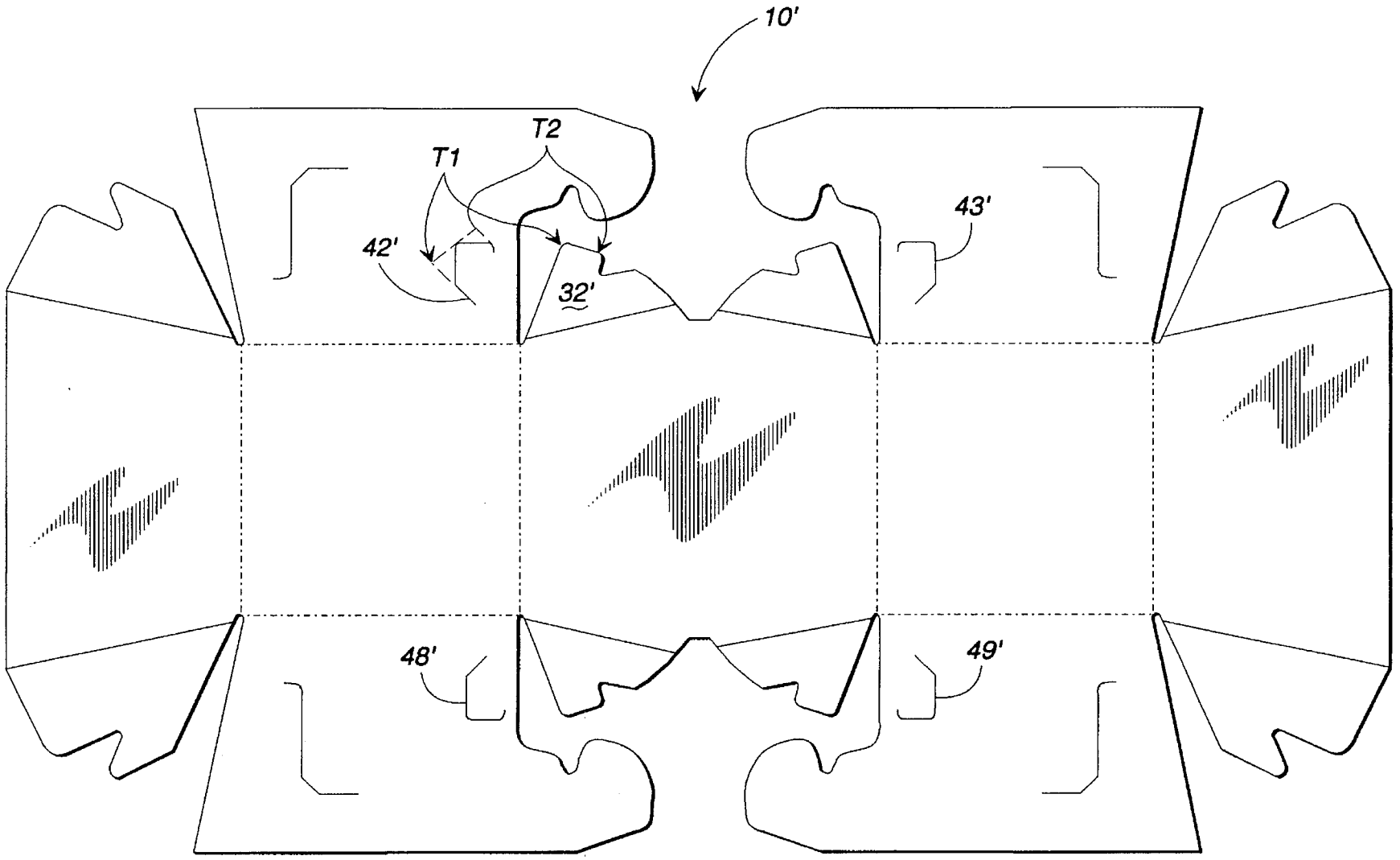
FIG. 12 is a view similar to that shown in FIG. 3, which shows a blank 10' similar but having some differences relative to blank 10 in FIG. 3.

Reference is now made to blank 10' in FIG. 12, which is similar to that shown as 10 in FIG. 3. However, there are certain differences between the two blanks. In blank 10', each of the locking slits 42', 43', 48', 49' are each modified to accept two tips T1, T2, (an upward pointing tip T2 in addition to an outward pointing tip T1) each of which are defined by each of the slightly modified keel flaps 30', 31.', 32', and 33'. Both tips would be punched in with the same action. The upward pointing tip T2 engagement will prevent the keel panels from collapsing outward should the overlapping hooks become disengaged. This engagement is somewhat more difficult to perform but may preferable when a carton is expected to encounter a harsh environment.

Additional Embodiments; Illustration of Versatility of Invention

FIGS. 10A–10H and 11A–11H illustrate the wide range of options available through use of the present invention. In each of these figures, the left side drawing is a transverse crossection of the carton, and the right side drawing is a side view. Using FIG. 10A as an example, 100 designates the keel, 101 designates the sides, and 102 designates the ends of the particular package under discussion.

Figure 10A:
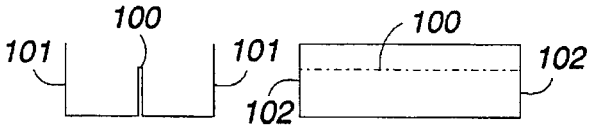
FIGS. 10A–10H are side cross sectional illustrative views illustrating various two-compartment options.
Figure 10B:
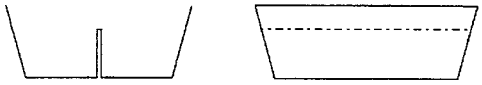
Figure 10C:
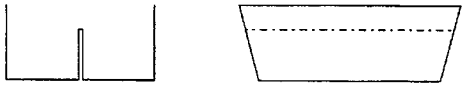
Figure 10D:
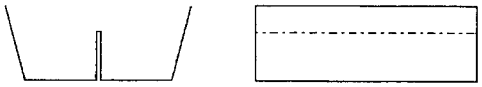
Figure 10E:
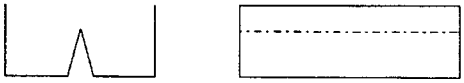
Figure 10F:
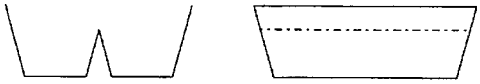
Figure 10G:
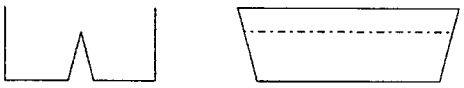
Figure 10H:
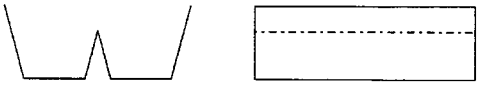

FIGS. 10A–10H illustrate some 2-compartment options, with FIG. 10A illustrating a vertical keel/vertical sides/vertical ends option, FIG. 10B illustrating a vertical keel/tapered sides/tapered ends option, FIG. 10C illustrating a vertical keel/vertical sides/tapered ends option, and FIG. 10D illustrating a vertical keel/tapered sides/vertical ends option. FIG. 10E illustrates a tapered keel/vertical sides/vertical ends option, FIG. 10F illustrates a tapered keel/tapered sides/tapered ends option, FIG. 10G illustrates a tapered keel/vertical sides/tapered ends option, and FIG. 10H illustrates a tapered keel/tapered sides/vertical ends option.

Figure 11A:
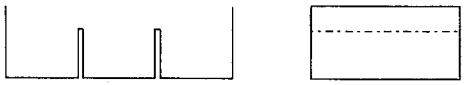
FIGS. 11A–11H are side cross sectional illustrative views illustrating various three-compartment options.
Figure 11B:
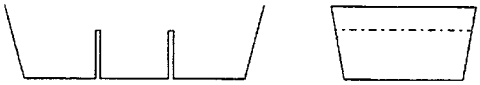
Figure 11C:
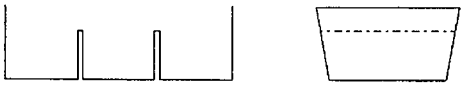
Figure 11D:
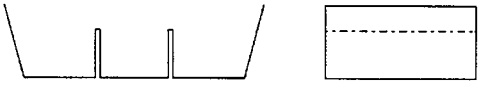
Figure 11E:
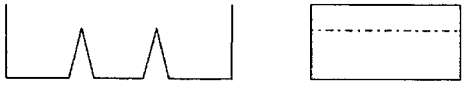
Figure 11F:
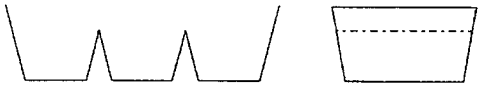
Figure 11G:
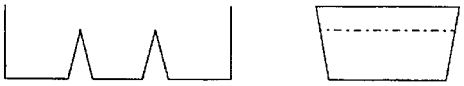
Figure 11H:
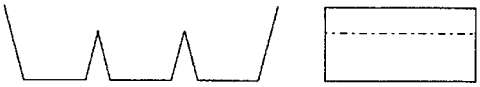

FIGS. 11A–11H illustrate some 3-compartment (two keel) options, with FIG. 11A illustrating a vertical keels/vertical sides/vertical ends option, FIG. 11B illustrating a vertical keels/tapered sides/tapered ends option, FIG. 11C illustrating a vertical keels/vertical sides/tapered ends option, and FIG. 11D illustrating a vertical keels/tapered sides/vertical ends option. FIG. 11E illustrates a tapered keels/vertical sides/vertical ends option, FIG. 11F illustrates a tapered keels/tapered sides/tapered ends option, FIG. 11G illustrates a tapered keels/vertical sides/tapered ends option, and FIG. 11H illustrates a tapered keels/tapered sides/vertical ends option.

Advantages

As may be seen, the formed trays are of such construction that two adjacent cells may flex up and down without disengaging the locks, losing strength, or fracturing paperboard panels.

Other Variations

The exact style of the corner locks is not critical to the invention. It may be understood that other lock designs may also be used without departing from the present invention.

As may be understood, differing types of paperboard or other foldable material may also be used without departing from the spirit and scope of the present invention. It should also be understood that a clear, translucent, or opaque cover (not shown) may be provided over the top of the container to protect and contain product contained therein.

Conclusion

Therefore, it may be seen that the present invention provides an improved container which can have one or more dividing keels, each of which provides structural integrity to a particular container, but may also be flexed without disadvantageously damaging or disassembling the container. This advantageous construction is provided by the use of front and rear panel notches, which lock to the keel, thus effectively locking the floor panel in place relative to its associated keel panel and providing integrity. However, flexing between the compartments on each side of the keel is possible by the open nature of the notch.

A wide range of options is also available under the present invention, including a range of available keel/cavity quantities, as well as a wide range of keel and side wall slopes up to vertical.

While this invention has been described in specific detail with reference to the disclosed embodiments, it will be understood that many variations and modifications may be effected within the spirit and scope of the invention as described in the appended claims.

What is claimed is:

1. A container comprising:

a first keel panel;

a second keel panel attached to said first keel panel along a first fold line, said first and second keel panels combining to at least partially form a keel;

a first floor panel attached to said first keel panel along a second fold line;

a second floor panel attached to said second keel panel along a third fold line; and a first notched side panel attached to said first base panel along a fourth fold line and defining an open-ended notch which fits over and accepts a portion of said keel by contacting at least said second keel panel upon the folding of said container along said first, second, third, and fourth fold lines, said notch having its open end generally directed towards the axis of said fourth fold line.

2. The container as claimed in claim 1, wherein said notch in said first notched side panel fits over and accepts said keel panel loosely enough to allow said first and second floor panels to be pivoted relative to each other along said first fold line without disengaging said notch from said keel.

3. The container as claimed in claim 2, further comprising a first keel flap foldably attached relative to said first keel panel for planar engagement said first side panel.

4. The container as claimed in claim 3, wherein said keel panels are substantially vertical.

5. The container as claimed in claim 3, wherein said keel panels are tapered outwardly and downwardly from their connecting first fold line.

6. The container as claimed in claim 1, further comprising a first keel flap foldably attached relative to said first keel panel for planar engagement with said first side panel.

7. The container as claimed in claim 1, further comprising:

a third keel panel attached to said second floor panel along a fifth fold line;

a fourth keel panel attached to said third keel panel along a sixth fold line, said third and fourth keel panels combining to form a second keel; and a third floor panel attached to said third keel panel along a seventh fold line.

8. A container comprising:

a first keel panel;

a second keel panel attached to said first keel panel along a first fold line, said first and second keel panel portions combining to at least partially form a keel;

a keel stop defined by one of said first and second keel panels;

a first floor panel attached to said first keel panel along a second fold line;

a second floor panel attached to said second keel panel along a third fold line;

a first notched side panel attached to said first base panel along a fourth fold line and also defining an interior stop surface configured to contact said keel stop upon the folding of said container along said first, second, third, and fourth fold lines, said first side panel also defining an open-ended notch which fits over and accepts a portion of said keel, said notch having its open end generally directed towards said fourth fold line; and a first keel flap foldably attached relative to said first keel panel for planar contact with an outside surface portion of said first notched side panel, such that said first notched side panel is captured between said keel stop and said first keel flap.

9. The container as claimed in claim 8, wherein said stop is an edge stop in the form of an inverted "V", defined by said first and second keel panels.

10. The container as claimed in claim 9, further comprising:

a third keel panel attached to said second floor panel along a fifth fold line;

a fourth keel panel attached to said third keel panel along a sixth fold line, said third and fourth keel panels combining to form a second keel; and a third floor panel attached to said third keel panel along a seventh fold line.

11. The container as claimed in claim 8, further comprising:

a third keel panel attached to said second floor panel along a fifth fold line;

a fourth keel panel attached to said third keel panel along a sixth fold line, said third and fourth keel panels combining to form a second keel; and a third floor panel attached to said third keel panel along a seventh fold line.

12. A container, comprising:

a first keel panel:

a second keel panel attached to said first keel panel along a first fold line, said first and second keel panels combining to at least partially form a keel;

a first floor panel attached to said first keel panel along a second fold line;

a second floor panel attached to said second keel panel along a third fold line;

a first side panel attached to said first base panel along a fourth fold line and defining an open-ended notch configured to engage said keel upon said folding of said container along said first, second, third, and fourth fold lines; and a first keel flap foldably attached relative to said first keel panel for planar engagement with said first side panel when said container is erect, wherein said notch in said locking flap contacts said second keel panel yet engages said keel loosely enough to allow said first and second floor panels to be pivoted relative to each other along said first told line without disengaging said notch from said keel.

13. The container as claimed in claim 12, wherein said keel panels are substantially vertical.

14. The container as claimed in claim 12, wherein said keel panels are tapered outwardly and downwardly from their connecting first fold line.

15. A container, comprising:

a first keel panel;

a second keel panel attached to said first keel panel along a first fold line, said first and second keel panels combining to at least partially form a keel;

a first floor panel attached to said first base panel along a second fold line;

a second floor panel attached to said second keel panel along a third fold line;

a first notched side panel attached to said first base panel along a fourth fold line and defining a first open-ended notch which fits over and accepts a portion of said keel and contacts said second keel panel upon the folding of said container along said first, second, third, anti fourth fold lines, said notch having its open end generally directed towards the axis of said fourth fold line;

a second notched side panel attached to said first base panel along a fourth fold line and defining a second open-ended notch which fits over and accepts a portion of said keel contacts said first keel panel and substantially registers with said first open-ended notch upon the folding of said container along said first, second, third, fourth, and fifth fold lines, said second open-ended notch having its open end generally directed towards the axis of said fifth fold line.

16. The container as claimed in claim 15, wherein said first and second notched side panels have portions in planar contact with each other and are configured to slide relative to each other.

17. The container as claimed in claim 16, further comprising:

a first keel flap foldably attached relative to said first keel panel for planar contact with an outside surface portion of said first notched side panel; and a second keel flap foldably attached relative to said second keel panel for planar contact with an outside surface portion of said second notched side panel, such that said first notched side panel tends to be captured between said keel stop and said first keel flap, and said second notched side panel tends to be captured between said second keel flap and said first notched side panel.

18. The container as claimed in claim 15, further comprising:

a first keel flap foldably attached relative to said first keel panel for planar contact with an outside surface portion of said first notched side panel; and a second keel flap foldably attached relative to said second keel panel for planar contact with an outside surface portion of said second notched side panel, such that said first notched side panel tends to be captured between said keel stop and said first keel flap, and said second notched side panel tends to be captured between said second keel flap and said first notched side panel.

19. The container as claimed in claim 18, wherein said first keel flap also captures a portion of said second notched side panel between it and said first notched side panel.

20. A container, comprising:

a first keel panel;

a second keel panel attached to said first keel portion along a first fold line, said first and second keel panel portions combining to at least partially form a keel;

a keel stop defined by one of said first and second keel panels;

a first floor panel attached to said first keel portion along a second fold line;

a second floor panel attached to said second keel portion along a third fold line;

a first side panel attached to said first base panel along a fourth fold line and also defining an interior stop surface contacts said keel stop upon the folding of said container along said first, second, third, and fourth fold lines; and a first keel flap foldably attached relative to said first keel panel for planar contact with an outside surface portion of said first side panel, such that said first side panel is captured between said keel stop and said first keel flap.

* * * * *